US009780488B2

(12) United States Patent
Fu et al.

(10) Patent No.: US 9,780,488 B2
(45) Date of Patent: Oct. 3, 2017

(54) CONNECTOR AND CONNECTOR ASSEMBLY

(71) Applicant: Tyco Electronics (Shanghai) Co. Ltd., Shanghai (CN)

(72) Inventors: Xiaozhi Fu, Shanghai (CN); Ming Shi, Shanghai (CN); Xiang Xu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/222,247

(22) Filed: Jul. 28, 2016

(65) Prior Publication Data

US 2017/0033499 A1 Feb. 2, 2017

(30) Foreign Application Priority Data

Jul. 31, 2015 (CN) ..... 2015 2 0570477 U

(51) Int. Cl.

| | |
|---|---|
| ***H01R 11/22*** | (2006.01) |
| ***H01R 13/11*** | (2006.01) |
| ***H01R 13/635*** | (2006.01) |
| ***H01R 4/48*** | (2006.01) |
| ***H01R 9/24*** | (2006.01) |
| ***H01R 12/51*** | (2011.01) |

(52) U.S. Cl.

CPC ..... *H01R 13/635* (2013.01); *H01R 4/4827* (2013.01); *H01R 9/2408* (2013.01); *H01R 9/2416* (2013.01); *H01R 12/515* (2013.01)

(58) Field of Classification Search

CPC ..... H01R 4/4818; H01R 4/48; H01R 4/4827; H01R 4/4836; H01R 4/4845; H01R 12/57

USPC ..... 439/856, 857, 682, 834, 441

See application file for complete search history.

(56) References Cited

U.S. PATENT DOCUMENTS

| | | | | |
|---|---|---|---|---|
| 4,759,726 | A * | 7/1988 | Naylor | H01R 4/5008 439/441 |
| 6,851,967 | B2 * | 2/2005 | Miyoshi | H01R 4/4836 439/441 |
| 7,491,098 | B1 * | 2/2009 | Pijoan-Parellada | H01R 4/4836 439/786 |
| 7,896,685 | B2 * | 3/2011 | Eppe | H01H 1/5844 439/441 |
| 8,968,022 | B2 * | 3/2015 | Mostoller | H01R 4/4836 439/438 |
| 9,209,530 | B2 * | 12/2015 | Gassauer | H01R 4/4836 |
| 9,263,822 | B2 * | 2/2016 | Wu | H01R 13/2407 |
| 9,444,155 | B2 * | 9/2016 | Chen | H01R 4/48 |
| 9,472,871 | B2 * | 10/2016 | Lin | H01R 12/53 |
| 9,484,639 | B1 * | 11/2016 | Chen | H01R 4/4845 |
| 2004/0116001 | A1 * | 6/2004 | Lenker | H01R 4/4836 439/835 |
| 2004/0161962 | A1 * | 8/2004 | Kikuchi | H04R 5/04 439/441 |

* cited by examiner

*Primary Examiner* — Abdullah Riyami
*Assistant Examiner* — Thang Nguyen
(74) *Attorney, Agent, or Firm* — Barley Snyder

(57) ABSTRACT

A connector is disclosed. The connector has a housing and a conductive terminal disposed in the housing. The conductive terminal has a pair of resilient contact arms biased toward each other and a releasing mechanism adapted to move the pair of resilient contact arms away from each other.

17 Claims, 6 Drawing Sheets

CONNECTOR AND CONNECTOR ASSEMBLY

CROSS-REFERENCE TO RELATED APPLICATIONS

This application claims the benefit of the filing date under 35 U.S.C. §119(a)-(d) of Chinese Patent Application No. 201520570477.3, filed on Jul. 31, 2015.

FIELD OF THE INVENTION

The present invention relates to a connector and a connector assembly, and more particularly, to a connector and a connector assembly connected to a wire.

BACKGROUND

In many known electrical connectors, once a wire is inserted into the connector it cannot be removed intact and cannot be replaced. Furthermore, the housings of known connectors are molded to accommodate a particular number of conductive terminals of specific sizes and shapes. Providing a plurality of different molds to manufacture connector housings receiving different numbers of conductive terminals is costly and inefficient.

SUMMARY

An object of the invention, among others, is to provide a connector allowing repeated insertion and removal of a wire, which can be assembled with other identical connectors to accommodate different numbers of conductive terminals. The disclosed connector has a housing and a conductive terminal disposed in the housing. The conductive terminal has a pair of resilient contact arms biased toward each other and a releasing mechanism adapted to move the pair of resilient contact arms away from each other.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
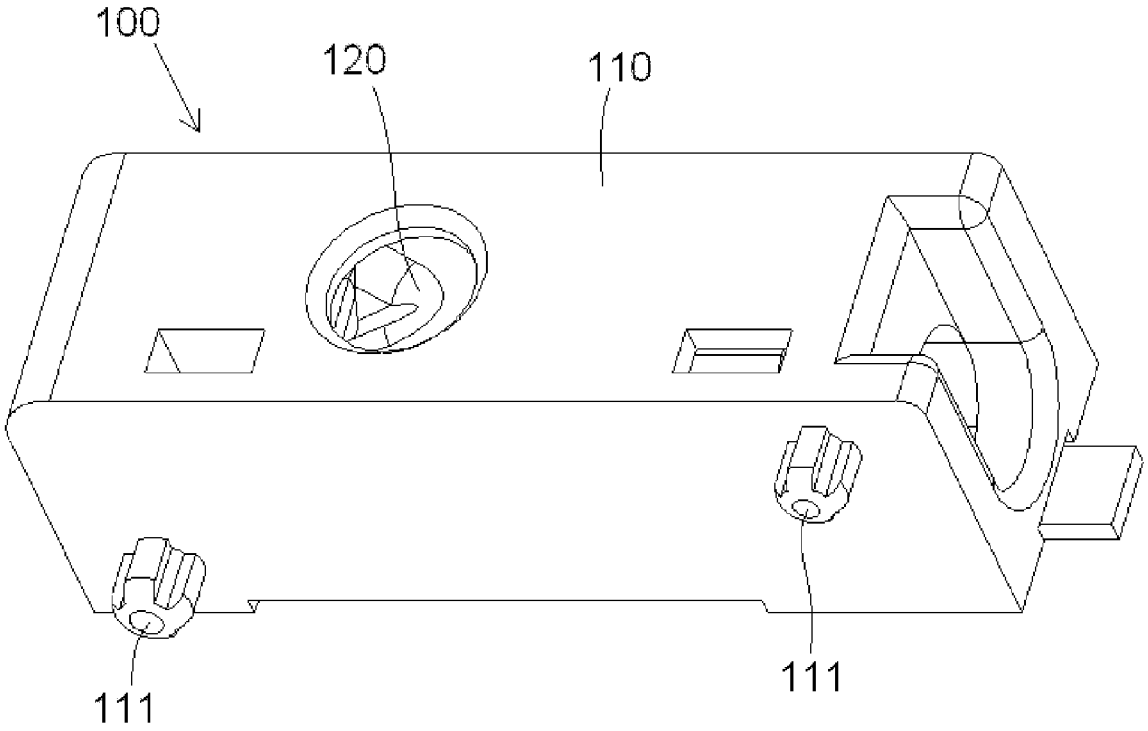
FIG. 1 is a perspective view of a connector according to the invention.
Figure 2:
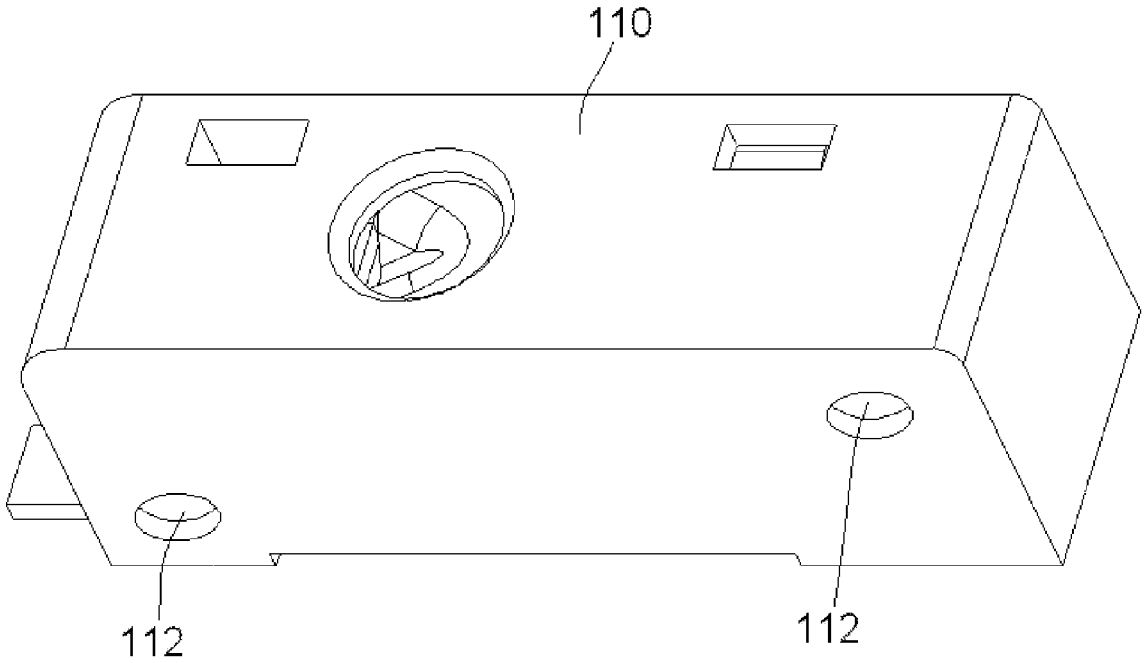
FIG. 2 is another perspective view of the connector of FIG. 1.

A connector 100 according to the invention is shown generally in FIGS. 1 and 2. The connector 100 has a housing 110 and a conductive terminal 120.

The major components of the invention will now be described in greater detail.

Figure 6:
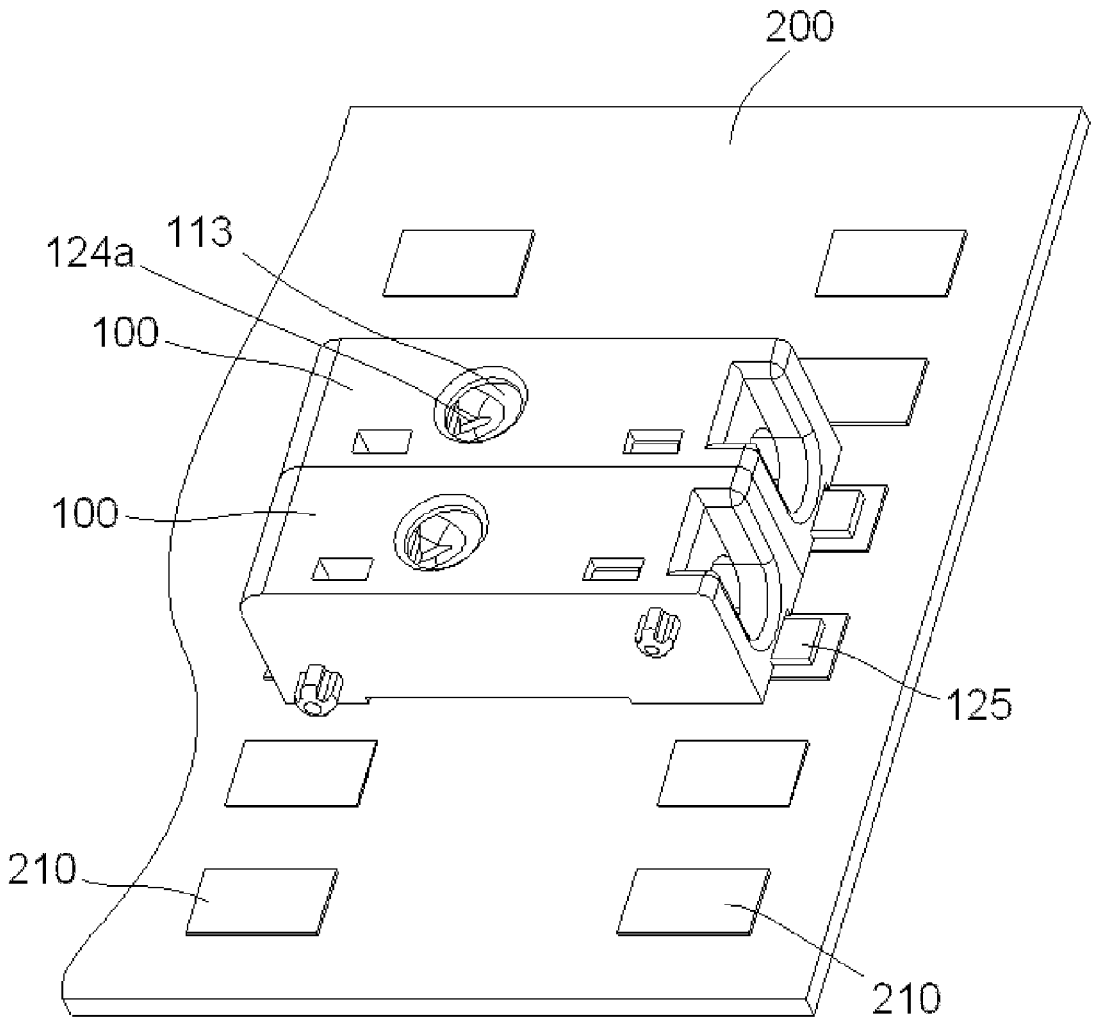
FIG. 6 is a perspective view of a plurality of connectors of FIG. 1 and a circuit board.

The housing 110 is shown in FIGS. 1, 2, and 6. In the shown embodiment, the housing 110 is made of an insulative material, such as a plastic, and is formed by molding. As shown in FIGS. 1 and 2, the housing 110 has a first side wall and an opposite second side wall. The first side wall is provided with a plurality of projections 111, and the second side wall is provided with a plurality of connecting holes 112 respectively corresponding to the plurality of projections 111. As shown in FIG. 6, a through hole 113 is formed in a top wall of the housing 110 and extends into an interior of the housing 110.

Figure 3:
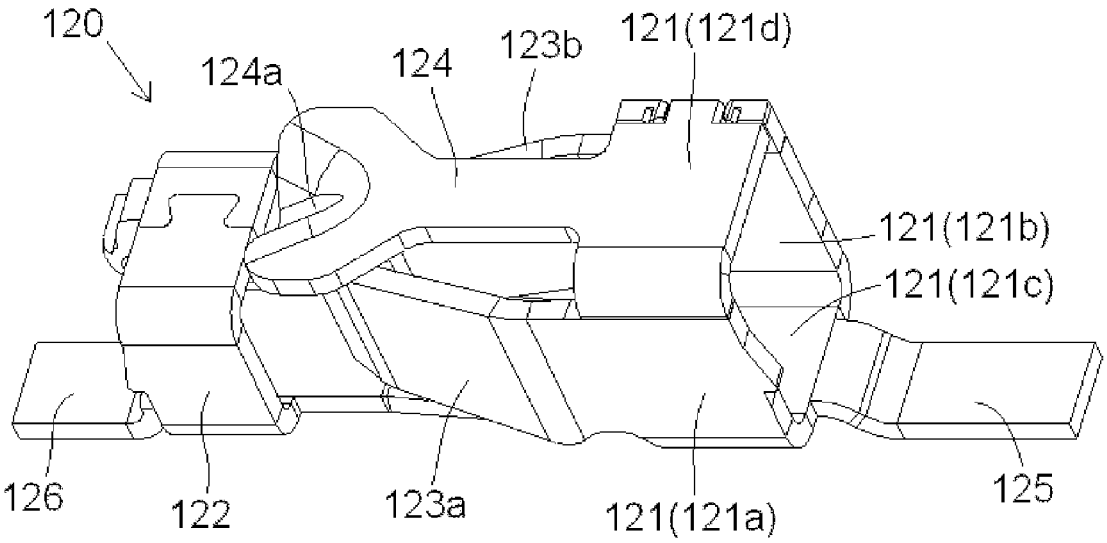
FIG. 3 is a perspective view of a conductive terminal of the connector of FIG. 1.

The conductive terminal 120 is shown in FIG. 3. The conductive terminal 120 has a first annular end portion 121 located at a first end and a second annular end portion 122 located at an opposite second end. The first annular end portion 121 has a first side 121*a*, an opposite second side 121*b*, a bottom 121*c*, and a top 121*d*. The conductive terminal has a pair of resilient contact arms 123*a*, 123*b*, a releasing mechanism 124, 124*a*, a first solder foot 125, and a second solder foot 126.

The pair of resilient contact arms 123*a* and 123*b* are cantilevered and have a fixed end and a free end. The fixed end of the first resilient contact arm 123*a* is attached to the first side 121*a* of the first annular end portion 121, and the fixed end of the second resilient contact arm 123*b* is attached to the second side 121*b* of the first annular end portion 121. The free ends of each of the first resilient contact arm 123*a* and the second resilient contact arm 123*b* extend from the first annular end portion 121 toward the second end and center of the conductive terminal 120 such that they are biased toward each other.

The releasing mechanism 124, 124*a* includes a cantilever 124 and a wedged protrusion 124*a*. A first end of the cantilever 124 is attached to the top 121*d*, and the cantilever 124 extends to an opposite second end in a direction toward the second end of the conductive terminal 120. The wedged protrusion 124*a* is disposed at the second end of the cantilever 124. The wedged protrusion 124*a* is adapted to be inserted between the pair of resilient contact arms 123*a* and 123*b* to move the pair of resilient contact arms 123*a* and 123*b* in a direction away from each other.

The first solder foot 125 extends from the bottom 121*c* in a direction away from the conductive terminal 120, and the second solder foot 126 extends from the bottom of the second annular end portion 122 in a direction away from the conductive terminal 120.

Figure 7:
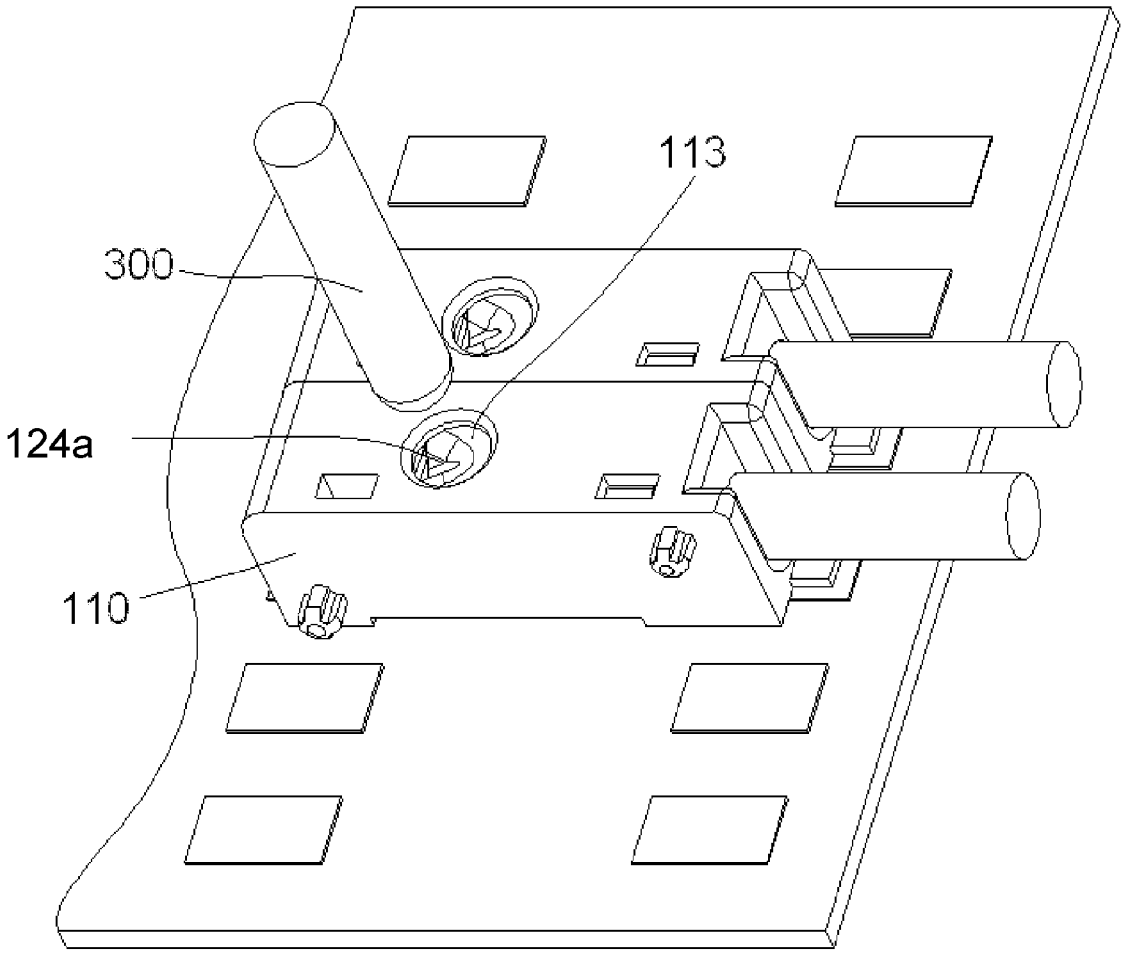
FIG. 7 is a perspective view of the plurality of connectors and circuit board of FIG. 7 and an external releasing tool.

The housing 110 receives the conductive terminal 120 such that the conductive terminal 120 is disposed in an interior of the housing 110, as shown in FIGS. 1, 2, 6, and 7. The first solder foot 125 and the second solder foot 126 extend outside a bottom wall of the housing 110, as shown in FIGS. 6 and 7, and the through hole 113 aligns with the wedged protrusion 124*a*.

Figure 4:
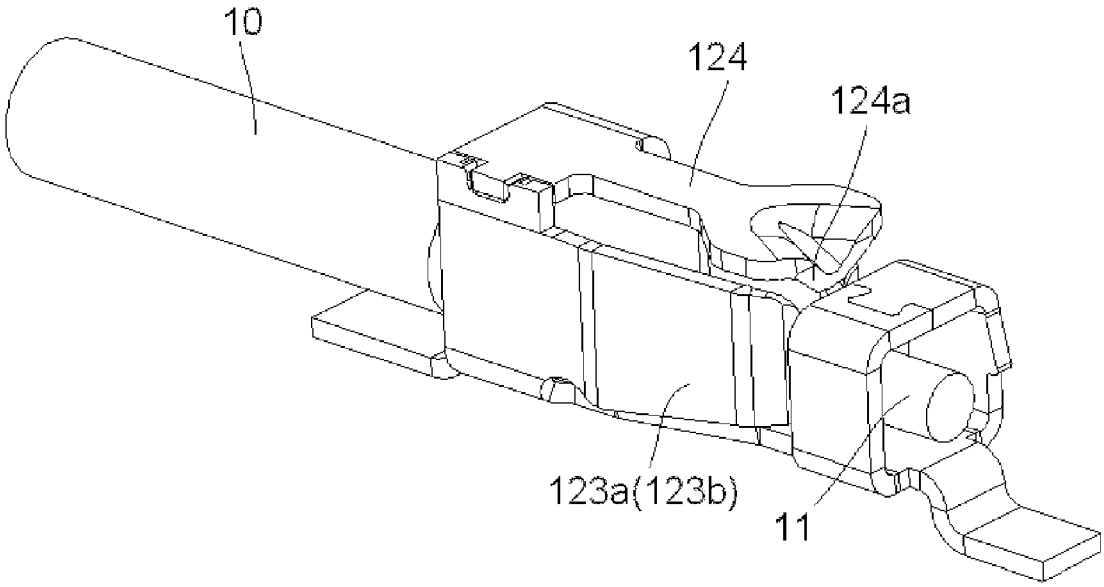
FIG. 4 is a perspective view of the conductive terminal of FIG. 3 and a wire.
Figure 5:
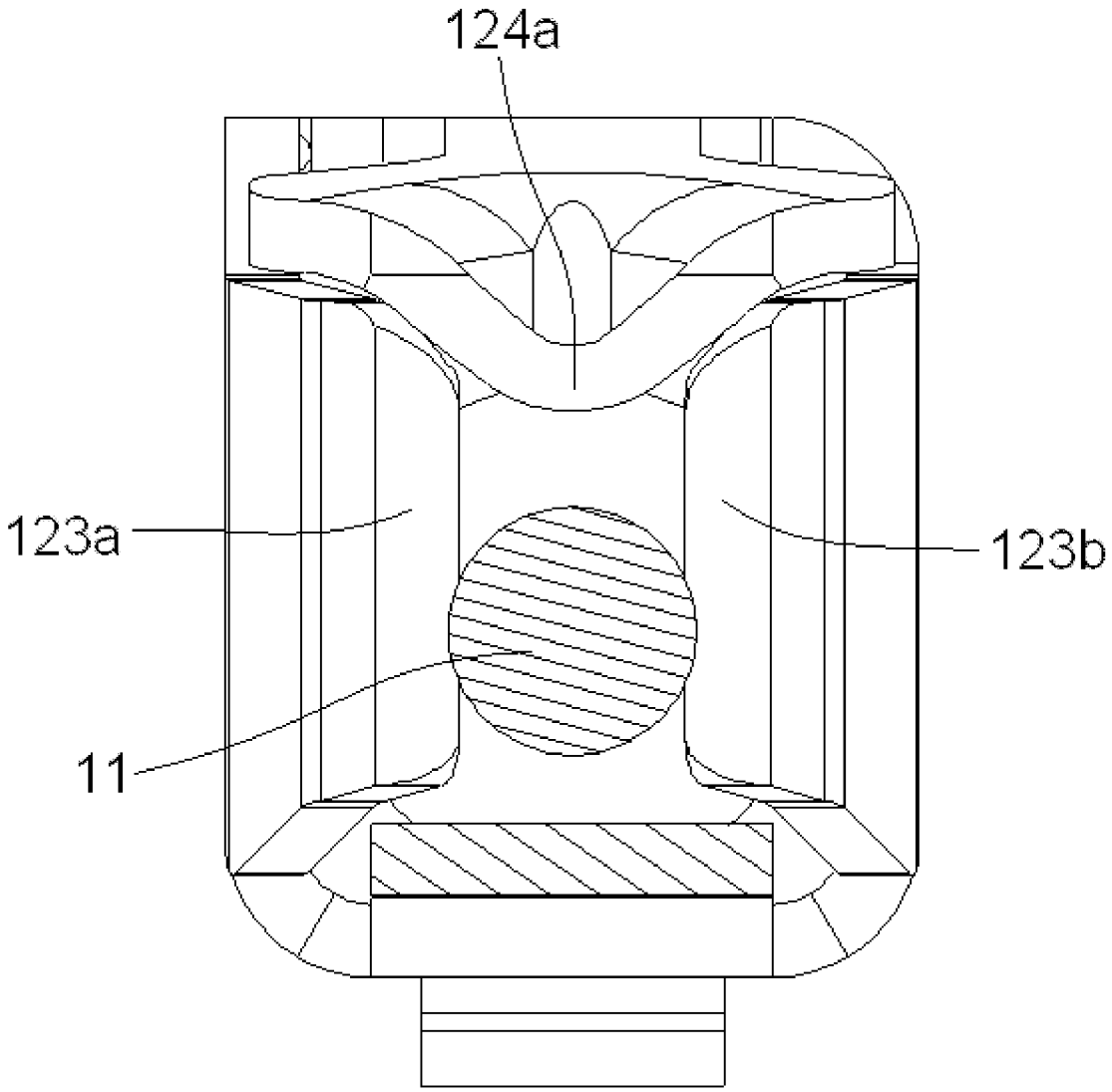
FIG. 5 is a sectional front view of the conductive terminal and wire of FIG. 4.

The attachment of the connector 100 to a wire 10 will now be described in greater detail with reference to FIGS. 4 and 5. The wire 10 has a conductor 11. The conductor 11 of the wire 10 is inserted between the pair of resilient contact arms 123*a* and 123*b* through the first annular end portion 121. An end of the conductor 11 is disposed in the second annular end portion 122. The pair of resilient contact arms 123*a* and

123*b* contact and clamp the conductor 11 when the wire 10 is inserted into the connector 100. As shown in FIGS. 4, 5 and 7, the releasing mechanism 124, 124*a*, when pressed down in a vertical direction, is adapted to move the pair of resilient contact arms 123*a* and 123*b* in a direction away from each other so as to release the clamped conductor 11.

The attachment of the connector 100 to a circuit board 200 will now be described in greater detail with reference to FIGS. 6 and 7. The first solder foot 125 and the second solder foot 126 are each soldered to pads 210 on the circuit board 200 by means of surface-mount technology (SMT), in which electronic components are mounted directly onto the surface of a circuit board.

An external releasing tool 300, as shown in FIG. 7, is adapted to be inserted into the through hole 113 to press the wedged protrusion 124*a* downward, so as to move the pair of resilient contact arms 123*a* and 123*b* away from each other, releasing the conductor 11 as described above. In the shown embodiment, the external releasing tool 300 is a cylindrical member.

As also shown in FIGS. 6 and 7, the projections 111 of the connector 100 are adapted to be inserted into corresponding connecting holes 112 of another connector 100. The projections 111 on one of two adjacent connectors 100 are inserted into the connecting holes 112 in the other, respectively, thus assembling the two adjacent connectors 100 together. A plurality of connectors 100 may be assembled together side by side and soldered to the circuit board 200.

Advantageously, in the connector 100 according to the invention, since the conductive terminal 120 comprises a wire releasing mechanism, the conductor 11 of the wire 10 may be plugged in and pulled out of the connector 100 repeatedly, permitting convenient replacement of the wire 10. Furthermore, since identical connectors 100 may be connected to each other, only one mold is required to form a connector assembly with different numbers of conductive terminals 12, reducing manufacturing costs.

What is claimed is:

1. A connector, comprising:

a housing; and a conductive terminal disposed in the housing having a base, a first annular end portion disposed on an a first end of the base, a second annular end portion disposed on an opposite second end of the base, a pair of resilient contact arms biased toward each other, and a releasing mechanism disposed between the first annular end portion and the second annular end portion and adapted to move the pair of resilient contact arms away from each other.

2. The connector of claim 1, wherein the housing is formed of an insulative material.

3. The connector of claim 2, wherein the releasing mechanism has a cantilever and a wedged protrusion disposed on an end of the cantilever.

4. The connector of claim 3, wherein the wedged protrusion is inserted between the pair of resilient contact arms to move the resilient contact arms away from each other.

5. The connector of claim 4, wherein a conductor is insertable between the pair of resilient contact arms through the first annular end portion.

6. The connector of claim 5, wherein each resilient contact arm extends from a side of the first annular end portion toward the second end of the conductive terminal.

7. The connector of claim 6, wherein the cantilever extends from a top of the first annular end portion toward the second end of the conductive terminal.

8. The connector of claim 7, wherein an end of the conductor is disposed within the second annular end portion.

9. The connector of claim 8, wherein the conductive terminal has a first solder foot extending from a bottom of the first annular end portion in a direction away from the conductive terminal and a second solder foot extending from a bottom of the second annular end portion in a direction away from the conductive terminal.

10. The connector of claim 9, wherein the first solder foot and the second solder foot are soldered to pads of a circuit board.

11. The connector of claim 10, wherein a top wall of the housing has a through hole aligned with the wedged protrusion.

12. The connector of claim 11, further comprising an external releasing tool insertable into the through hole to move the wedged protrusion between the pair of resilient contact arms.

13. The connector of claim 12, wherein the external releasing tool is cylindrical.

14. The connector of claim 1, wherein the housing has a first side wall having a plurality of projections and an opposite second side wall having a plurality of connecting holes corresponding to the plurality of projections.

15. A connector assembly, comprising:

a plurality of connectors each having a housing including a first side wall having at least one projection and an opposite second side wall having at least one complementary connecting hole corresponding to the projection, the projection of a first one of the connectors bring insertable into the connecting hole of a second one of the connectors to attach the connectors side by side; and a conductive terminal disposed in the housing having a base, a first annular end portion disposed on a first end of the base, a second annular end portion disposed on an opposite second end of the base, a pair of resilient contact arms biased toward each other, and a releasing mechanism disposed between the first annular end portion and the second annular end portion and adapted to move the pair of resilient contact arms away from each other.

16. The connector assembly of claim 15, further comprising an external releasing tool contacting the releasing mechanism to move the pair of resilient contact arms away from each other.

17. The connector assembly of claim 16, wherein the external releasing tool is a cylindrical member insertable into a through hole disposed in a top wall of the housing.

* * * * *